United States Patent [19]

Hoskinson

[11] Patent Number: 4,744,313

[45] Date of Patent: May 17, 1988

[54] AIR SUPPLY APPARATUS FOR AN INCINERATOR

[76] Inventor: Gordon H. Hoskinson, 186 Mayfair Rd., Floral Park, N.Y. 11001

[21] Appl. No.: 41,109

[22] Filed: Apr. 22, 1987

Related U.S. Application Data

[62] Division of Ser. No. 881,253, Jul. 2, 1986, Pat. No. 4,674,417.

[51] Int. Cl.[4] ..... F23G 5/00

[52] U.S. Cl. ..... 110/254; 110/182.5; 110/302; 122/6.6

[58] Field of Search ..... 110/233, 234, 235, 251, 110/254, 297–302, 306, 308, 309, 313, 322–326, 182.5; 122/6.6, 235 B; 266/265

[56] References Cited

U.S. PATENT DOCUMENTS

| | | | |
|---|---|---|---|
| 1,802,475 | 4/1931 | Lucke | 110/297 X |
| 4,258,633 | 3/1981 | Elderheld | 110/182.5 |
| 4,291,633 | 9/1981 | Hoskinson | 110/235 |
| 4,444,127 | 4/1984 | Spronz | 110/235 |
| 4,538,529 | 9/1985 | Temelli | 110/251 X |

*Primary Examiner*—Steven E. Warner

*Attorney, Agent, or Firm*—Andrus, Sceales, Starke & Sawall

[57] ABSTRACT

A water-cooled air supply system for the combustion chamber of an incinerator. A longitudinal trough is formed in the lower end of the combustion chamber and a plurality of air supply tubes are spaced above the bottom of the trough. Elongated shrouds are secured in spaced relation to the upper and lower portions of each air supply tube and define cooling passages that receive a cooling medium. A plurality of outlet ports are located in each side of each air supply tube between the spaced edges of the shrouds and air is discharged from the ports into the lower end of the combustion chamber.

7 Claims, 3 Drawing Sheets

AIR SUPPLY APPARATUS FOR AN INCINERATOR

This is a division of application Ser. No. 06/881,253, filed July 2, 1986 now U.S. Pat. No. 4,674,417.

BACKGROUND OF THE INVENTION

One of the problems encountered in conventional incinerator design is the heat buildup in the combustion chamber. During the course of the combustion process, the air inlet conduit through which air is introduced into the combustion chamber become heated, resulting in the combustion air expanding and slowing the burning rate. This design problem, is commonly referred to as "burndown".

Ash removal problems have also been encountered with the conventional commercial or industrialtype incinerator. In certain types of incinerators, it is necessary to shut down the combustion in order to manually remove the ash from the combustion chamber and this downtime adversely effects the overall efficiency of the incinerator.

In other incinerators, conveyors have been employed in the lower end of the combustion chamber, which when operated, serve to convey the ash from the combustion chamber to a discharge site. However, due to the intense heat generated in the combustion chamber, the conveyors rapidly deteriorate, thereby requiring substantial maintenance.

In larger commercial incinerators, grates are employed and periodically the grates are agitated to drop the ash to a conveyor system located beneath the grates. However, the grates can become clogged with clinkers and non-combustible materials, and the mechanism for operating the grates is expensive.

Further difficulties have been experienced in incinerator design in achieving complete combustion of the combustible waste material. In order to increase the efficiency of the combustion and reduce the discharge of pollutants into the atmosphere, the incinerator often includes a secondary zone of combustion in the stack, where air is delivered to the stack to burn the combustible waste gases.

Recently, with the increased use of plastic materials, it has been found that the conventional incinerator system is not totally effective in preventing the discharge of gaseous pollutants to the atmosphere. This is due to the greater BTU content of the plastic material and the higher temperatures involved in the combustion. In an attempt to provide more effective combustion of plastic materials, attempts have been made to increase the input of gas, or other fuel, to the incinerator. However, the increased rate of combustion has correspondingly increased the velocity of gas flow through the stack. Thus, air introduced into the stack for secondary combustion purposes merely flows along the inner wall of the stack without adequately mixing with the waste gases, which flow upwardly along the central portion of the stack. The result is a "candlestick" effect, with the air flowing along the refractory wall of the stack and the waste gases flowing along the central core. The laminar flow of the air and gas prevents adequate mixing of the air with the waste gases, with the result that incomplete combustion is obtained.

SUMMARY OF THE INVENTION

The invention is directed to an improved incinerator having a unique water-cooled air supply for the combustion chamber.

The incinerator defines a combustion chamber and waste is fed into the combustion chamber at an angle to the longitudinal axis of the combustion chamber, so that the waste will roll off the walls of the combustion chamber and will not be compacted against the walls.

The lower end of the combustion chamber is provided with a flat-bottomed, longitudinally extending, trough and air is supplied to the combustion chamber for combustion purposes through a plurality of longitudinal water cooled air tubes which are spaced above the bottom of the trough. The water cooled air supply enables the air to be maintained at an optimum uniform temperature, resulting in a combustion process that takes place at a constant rate to provide maximum efficiency.

The ash removal system includes a pair of endless chains that are mounted to travel in longitudinal grooves in the sides of the trough. A plurality of cleats connect the chains and the cleats extend only along a portion of the length of the chains, so that during the combustion process, the cleats will not be located in the combustion chamber, where they would be exposed to the intense heat of combustion. To remove ash, the chains are operated to move the cleats along the bottom of the trough to convey ash out of the combustion chamber to a discharge site.

The ash removal system enables the ash to be removed during the combustion operation, so that no downtime is required for the ash removal process. In addition, the conveyor chains are mounted within recesses in the side walls of the trough and are thus protected from the intense heat of combustion. In addition, the conveying cleats are not located within the combustion chamber during the combustion process. Thus, the ash conveying mechanism is protected from the intense heat of the combustion process and will thereby have a substantially increased service life.

The stack through which the waste gases of combustion are discharged from the combustion chamber, is lined with a layer of refractory material and air is introduced into the stack through an elongated vertical tube that is mounted centrally of the stack and is composed of a ceramic material, such as silicon carbide. Formed along the length of the tube are a plurality of ports that face outwardly at an angle, so that air introduced into the tube will be directed downwardly and radially outward toward the refractory liner.

The air is discharged directly into the flow of waste gases passing upwardly through the stack, thereby creating extreme turbulence to increase the efficiency of combustion in the stack. Extremely high temperatures are obtained in the stack, in the range of 3000° F., and the reflected heat from the refractory liner is so intense that the combustion gases are completely burned. The result is that the stack construction substantially eliminates the discharge of gaseous pollutants into the atmosphere without the use of costly scrubbers or precipitators.

The stack construction of the invention can be used with any type of industrial or municipal incinerator and can be incorporated with new incinerators, or retrofitted to existing incinerators.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
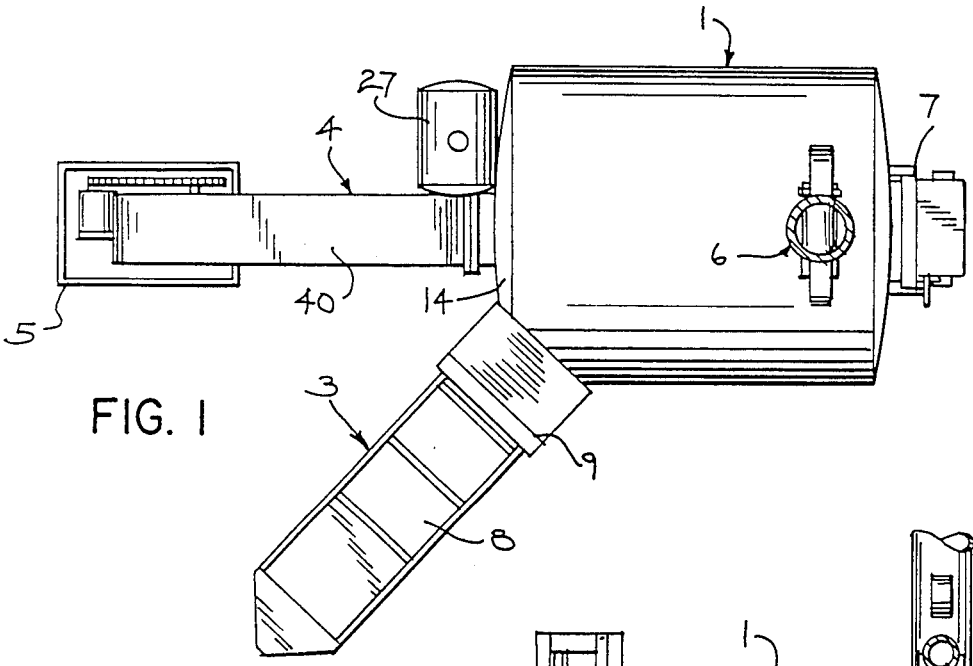
FIG. 1 is a top plan view of the incinerator of the invention.
Figure 2:
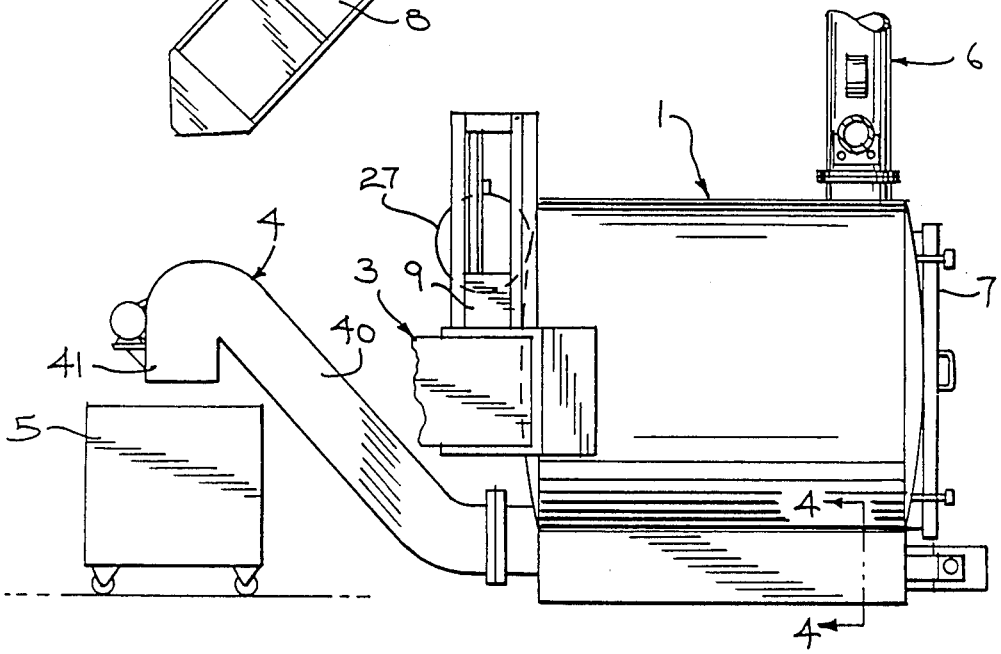
FIG. 2 is a side elevation of the incinerator.
Figure 3:
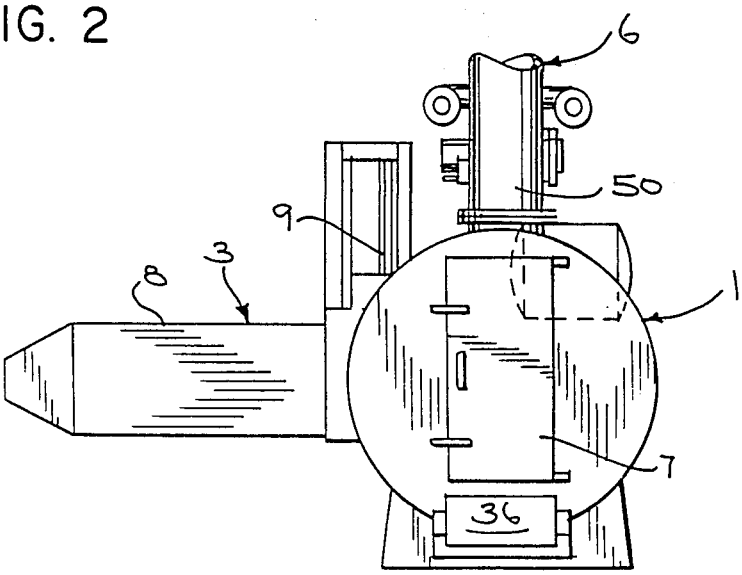
FIG. 3 is an end view of the incinerator.

FIGS. 1-3 show an industrial or commercial-type incinerator 1 that defines a combustion chamber 2 where combustible material or waste is burned. The waste is fed to the combustion chamber, through a feeder mechanism 3, which is disposed at an acute angle with respect to the longitudinal axis of the combustion chamber, and ash and non-combustible material are discharged from the combustion chamber through an ash discharge unit 4 and are deposited in a container 5. Waste gases of combustion are discharged from the combustion chamber 2 through a stack 6.

As best shown in FIG. 3, the end of the incinerator, opposite the ash discharge unit 4, is provided with a hinged access door 7, through which access can be had to the interior of the combustion chamber.

The feeding mechanism 3 is conventional and includes a hopper 8 into which the waste material is fed. A pusher mechanism, not shown, is operated to move the waste material through the feeder unit into the combustion chamber. The outlet of the feeder unit is enclosed by a vertically moving, guilliotine-type door 9. Door 9 is moved to the open position by a power operated mechanism, such as a hydraulic cylinder, to permit the waste material to be pushed into the combustion chamber and the door will be closed during the combustion operation.

Incinerator 1 is lined with a refractory material 10 and the lower end of the incinerator is provided with a trough 11 that extends longitudinally of the combustion chamber. The bottom of the trough is defined by a flat slab of refractory material 12.

Air is supplied to the combustion chamber 2 for combustion purposes through a plurality of air tubes 13 which extend longitudinally of the combustion chamber. The air volume is normally substantially less than the air requirements at rated capacity, which results in partial combustion and partial pyrolytic gasification of the waste material.

Air tubes 13 extend through openings in end wall 14 of incinerator 1 and are connected to an air supply hose 15 which, in turn, is connected to a suitable source of air under pressure.

Figure 5:
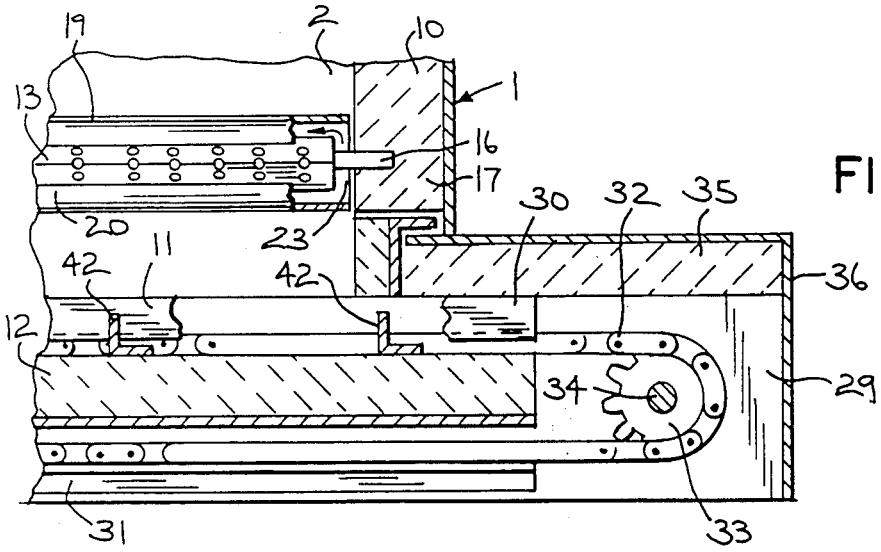
FIG. 5 is an enlarged longitudinal vertical section showing the end of the combustion chamber and the attachment of the air tube to the wall of the combustion chamber.

Air tubes 13 extend downwardly at an angle to the bottom 12 of trough 11, and the downstream ends of the air tubes are each provided with a pin 16, which are secured in a refractory block 17, as best shown in FIG. 5, which is located beneath door 7.

Figure 4:
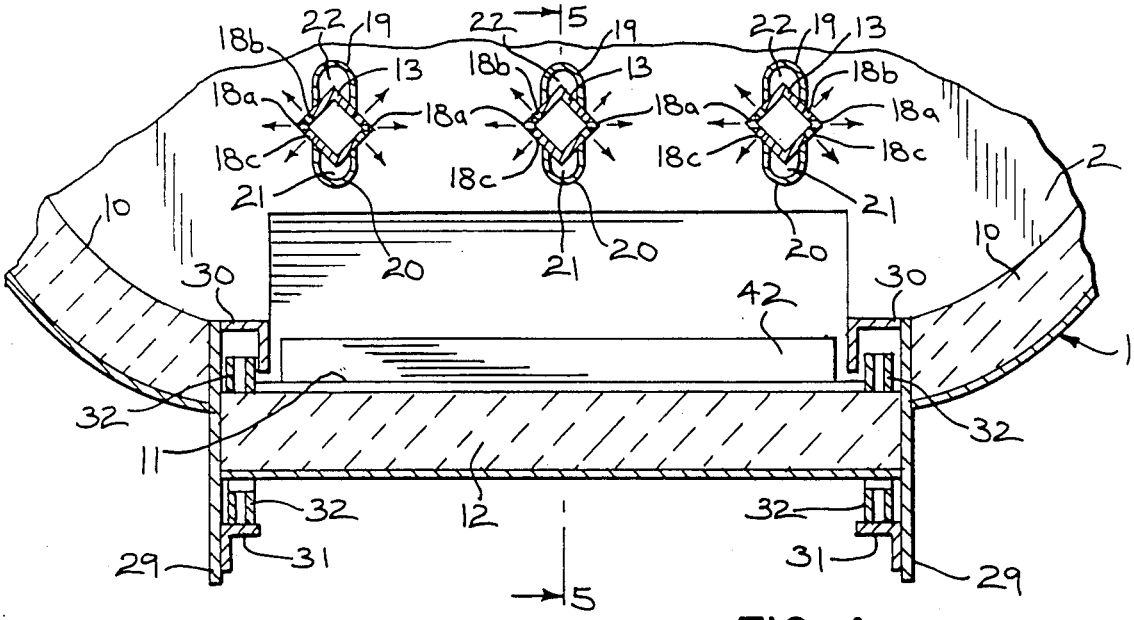
FIG. 4 is a fragmentary vertical section showing the air supply tubes for the combustion chamber and the mounting of the chains for the ash removal system.

As illustrated in FIG. 4, three air tubes 13 are utilized and each air tube is generally square in cross section and is formed with a plurality of ports 18 which are located in the sides of the tube. Ports 18 extend along the entire length of the tube, and as shown in FIG. 4, one group of ports 18*a* is directed horizontally outward through each corner of the tube, while a second group of ports 18*b* is located in each side of the tube and faces upwardly, and a third group of ports 18*c* is located in each side of the tube and faces downwardly toward the bottom 12 of trough 11.

In order to prevent burndown during extended periods of combustion, a unique water cooling system is employed for the air tubes 13. As shown in FIG. 4, a pair of shrouds 19 and 20 formed of a heat resistant alloy, such as stainless steel, are welded to the upper and lower portions, respectively, of air tubes 13 and the shrouds 19 and 20 define water cooling passages 21 and 22. Cooling water is introduced into the lower passage 21 and then passes through a connecting passage 23 at the downstream end of the tube 13 and is discharged through the upper passage 22.

The cooling water is supplied to the passage 21 by means of a pump 24, which is mounted on the outer surface of end wall 14. The discharge side of pump 24 is connected through line 25 to the inlet passage 21, while the outlet passage 22 is connected via a return line 26 to a surge tank 27 which is also mounted on the end wall 14 above pump 24. A line 28 connects the surge tank to the inlet side of pump 24. Thus, operation of pump 24 will introduce cooling water into the passage 21 and the water will flow through the passage to the downstream end of the air tube 13 and then flow through connecting passage 23 for return through passage 22 and line 26 to the surge tank 27.

By use of the cooling medium, the air being introduced into the combustion chamber will be maintained at an optimum and generally uniform temperature, resulting in a combustion process that will take place at a steady rate, thereby providing for maximum combustion efficiency and preventing burndown.

As best shown in FIGS. 4 and 5, trough 11 is defined by a pair of spaced vertical side plates 29 and a pair of angles 30 and 31 are secured in vertically spaced relation to each side plate. Angles 30 and 31 provide tracks for travel of a pair of endless chains 32. As shown in FIG. 4, the upper run of each chain 32 travels within the upper angle 30, while the lower run of each chain 32 travels in the lower channel 31.

The slab of refractory material 12 extends outwardly beyond the incinerator and is positioned between the spaced channels 30 and 31, as illustrated in FIG. 4.

Chains 32 are each engaged with an idler sprocket 33 and sprockets 33 are mounted on a common shaft 34 that is journalled in the side plates 29. A slab of refractory material 35 extends across the upper edges of the outer ends of side plates 29, as shown in FIG. 5, and a housing 36 covers slab 35 and connects the ends of side plates 29.

The chains 32 of the ash discharge unit 4 travel within an inclined chute 40 that extends outwardly and upwardly from end wall 14 and the upper end of chute 40 is provided with a downwardly facing outlet 41 through which the ash and non-combustible material is discharged into container 5.

To convey ash along the bottom of trough 11 and up chute 40, a plurality of spaced cleats 42 interconnect the chains 32. Cleats 42 do not extend along the entire length of the conveyor chains, but instead, a length of each chain, greater than the length of the combustion chamber 2, is devoid of cleats. Thus, during the combustion process, the portions of chains 32 devoid of cleats 42 will be located in angles 30 and 31 so that none of the cleats 42 will be exposed to the intense heat of combustion.

When it is desired to remove ash from the combustion chamber, chains 32 are operated causing the cleats 42 to enter trough 11 and move along bottom slab 12 to convey the ash and non-combustibles from the combustion chamber and up the chute 40 to the outlet 41.

Chains 32 are operated by a motor and transmission unit 43, which is mounted on the outer end of ash discharge unit 4 and the motor and transmission unit 43 is connected through a sprocket and chain drive 44 to a shaft 45 which carries a pair of drive sprockets, not shown, which are connected to the respective chains 32.

Figure 10:
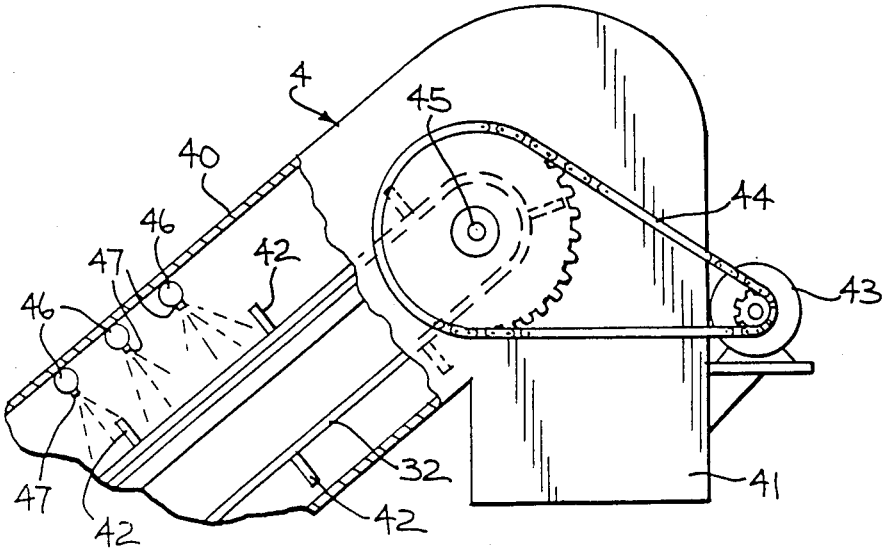
FIG. 10 is a fragmentary side elevation with parts broken away showing the ash removal conveyor.

As a further feature of the invention, ash being conveyed up chute 40 is sprayed with water to cool the ash and reduce dusting. The water is sprayed onto the ash through a group of water tubes 46 which extend across the chute and water is discharged from each of the tubes 46 through a series of jets or nozzles 47, as shown in FIG. 10.

Figure 6:
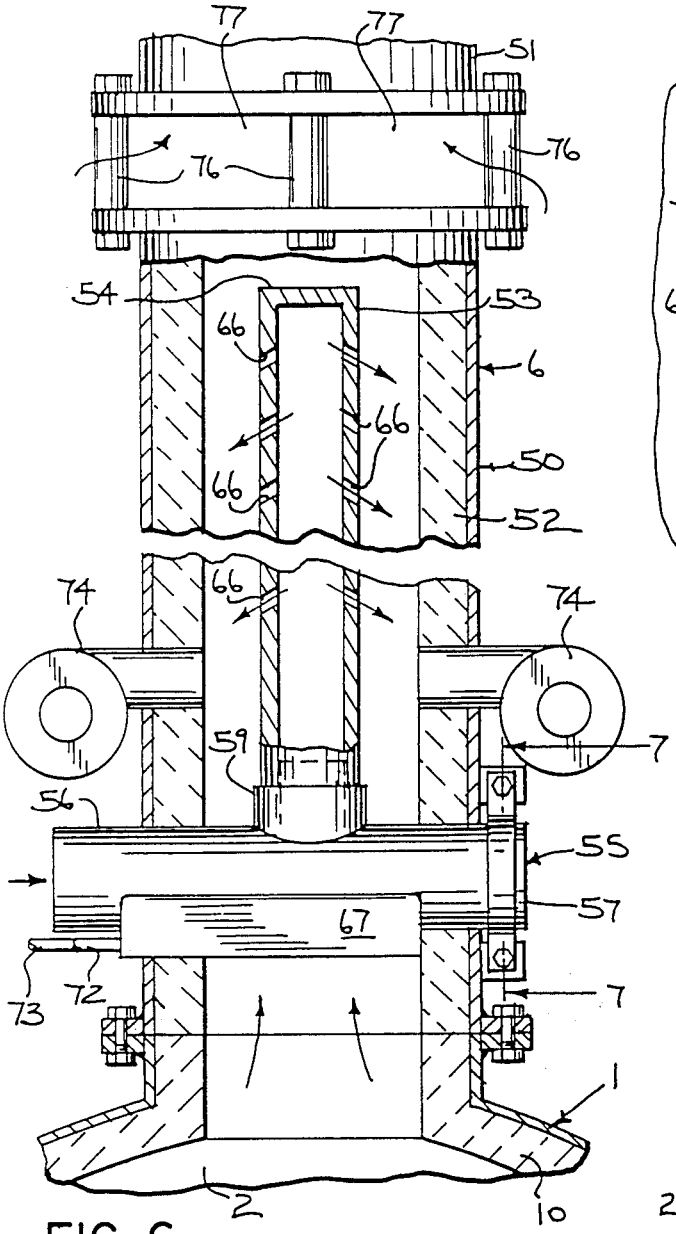
FIG. 6 is a longitudinal section of the stack.
Figure 7:
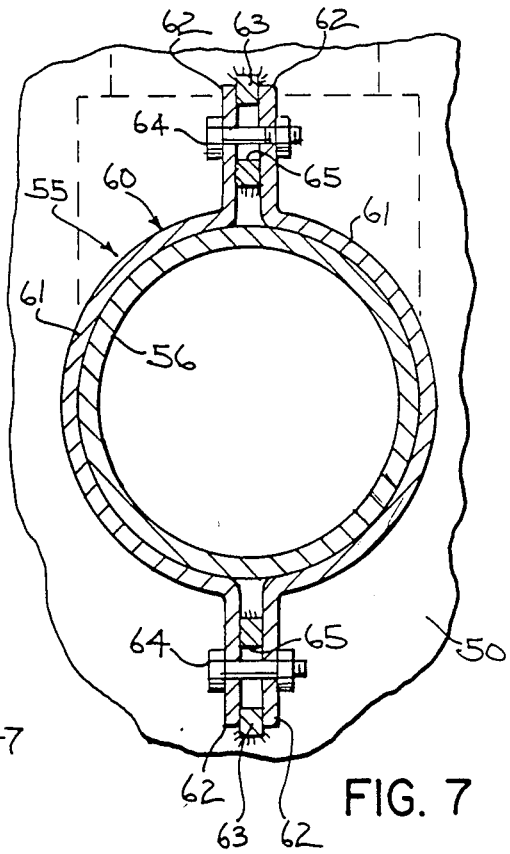
FIG. 7 is a section taken along line 7—7 of FIG. 6.
Figure 9:
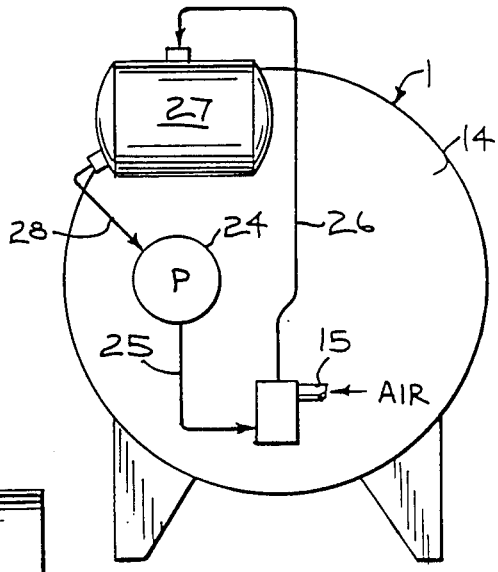
FIG. 9 is a schematic view of the end of the incinerator showing the water circulation system.
Figure 8:
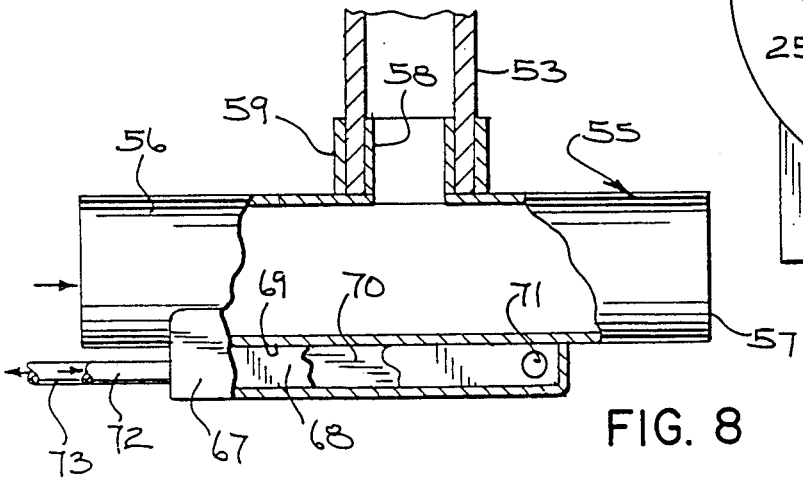
FIG. 8 is an enlarged side elevation with parts broken away of the air inlet conduit for the stack.

The stack construction of the invention is best illustrated in FIGS. 6–8. Stack 6 is composed of a lower stack section 50, and an upper stack section 51, both of which are preferably formed of steel and lined with a refractory material, indicated by 52.

Air is supplied to the lower stack section 50 to burn the combustible portion of the waste gases through an elongated vertical air tube 53, which is mounted centrally within lower stack section 50. Air tube 53 is preferably formed of a ceramic material, such as silicon carbide, which is capable of withstanding the intense temperatures generated in stack section 50. Generally, under normal operating conditions, the temperature in stack section 50 may reach 3000° F.

The upper end of air tube 53 is closed off by a cap 54 and the lower end of air tube 53 is mounted on an inlet assembly 55. Inlet assembly 55 is composed of a generally cylindrical inlet tube 56, which extends diametrically across stack 50. One end of tube 56 is connected through a suitable conduit to a blower, not shown, while the opposite end of air tube 56 is closed off by a cap 57. Extending upwardly from the central portion of air tube 56 is a nipple 58 and the lower end of tube 53 is fitted around nipple 58 and within a ring 59, which is secured to the upper surface of tube 56. A suitable refractory material can be employed to seal the lower end of air tube 53 within ring 59.

To ensure that vertical air tube 53 will be positioned concentrically of stack section 50, an adjustable clamp unit 60 is employed to connect the inlet tube 56 to the stack section 50. Clamping unit 60 includes a pair of C-shaped clamping sections 61 having mating flanges 62 on each end. Lugs 63 secured to stack section 50 are interposed between the mating flanges 62, as shown in FIG. 7. Bolts 64 extend through aligned openings in flanges 62, as well as through a vertically elongated slot 65 in the respective lug 63.

By loosening bolts 64, inlet tube 56 can be rotated and can also be tilted vertically because of the elongated slot 65. This enables the air tube 53 to be adjusted universally in position to ensure that the air tube is concentric with the stack section 50.

Air from the blower is discharged into inlet tube 56 and is directed through nipple 58 into air tube 53. The air then flows downwardly and outwardly from tube 53 through a plurality of downwardly inclined ports 66. Ports 66 are preferably located at an angle of about 30° to 60° with respect to the horizontal. As the air tube 53 has a substantial wall thickness, generally in the range of about one inch, ports 66 serve as nozzle or jets, so that the air will be directed at high velocity downwardly and outwardly toward the refractory wall 52. The air blasts through the combustion gases flowing upwardly within the stack section 50 to create extreme turbulence. Mixing of the air and waste gas increases the efficiency of the combustion process. This results in extremely high temperatures being generated in the stack section 50 and the reflected heat from the refractory liner 52 aids in achieving complete combustion of the waste gases.

To cool the air being introduced into the secondary combustion or thermal reactor zone, a cooling jacket 67 is secured to the lower surface of inlet tube 56. Cooling jacket 67 includes a longitudinal divider wall 68 which divides the jacket into an inlet chamber 69 and an outlet chamber 70. An opening 71 in the divider wall 68 provides communication between the chambers 69 and 70. A cooling medium, such as water is introduced into inlet chamber 69 through line 72 and the water will flow through the connecting opening 71 through outlet chamber 70 and is discharged through a line 73. The cooling medium serves to maintain the air at an optimum and uniform temperature for efficient combustion.

One or more conventional gas, or other fuel burners 74 can be mounted in the lower end of stack 50. The burners act in a conventional manner to provide a mixture of fuel and air to the lower portion of section 50 and the mixture can be ignited by a conventional igniter, not shown. The burners 74 are generally operated only at the start up of the incineration process and after a short period the stack temperature will be sufficiently high to support combustion, so that the operation of the burners can then be discontinued.

Upper stack section 51 is spaced from the upper end of lower stack section 50 by a series of circularly spaced channel-shaped spacers 76, which are connected to the respective flanges of the stack sections. The spaces 77 between spacers 76 define air passages through which air is drawn from the atmosphere by the draft of the combustion gases flowing within stack 51. The additional air ensures that any remaining combustible gases in the waste gases are burned.

The stack construction of the invention has particular use in incinerators which burn substantial quantities of plastic material. The increased BTU content of the plastic material will provide a corresponding increase in velocity of the combustion gases in the stack and the air inlet delivery of the invention, which directs the air downwardly and outwardly directly into the flow of waste gases and toward the refractory lining, will provide the necessary turbulence and mixing of air with the waste gases to achieve complete combustion.

various modes of carrying out the invention are contemplated as being within the scope of the following claims particularly pointing out and distinctly claiming the subject matter which is regarded as the invention.

I claim:

1. In an incinerator, means defining a combustion chamber, an air inlet tube disposed in the lower portion of a combustion chamber, means for supplying air to said air inlet tube, the sides of said air tube having a plurality of air outlet ports spaced along the length of said tube, a first elongated shroud secured to the upper portion of the air tube and defining with said air tube a first cooling medium passage, a second elongated shroud secured to the lower portion of the air tube and defining with said air tube a second cooling medium passage, means for supplying cooling medium to said first passage, means for discharging cooling medium from said second passage, and means for establishing communication between the downstream ends of said passages, said air tube being generally square in cross section and including a pair of opposed corners extending laterally outward in a horizontal plane, said first and second shrouds being generally U-shaped in cross section and each shroud including a pair of spaced legs and a connecting web, said legs being connected to said air tube adjacent said corners to expose opposed corner portions of said tube, said ports being located in said exposed corner portions.

2. The incinerator of claim 1, wherein said ports include a first group of ports facing upwardly and at an angle to the horizontal, a second group of ports facing downwardly at an angle to the horizontal and a third group of ports extending generally horizontal.

3. An incinerator, comprising a combustion chamber, an air tube assembly disposed in the lower portion of the combustion chamber, said air tube assembly comprising a central longitudinal air passage, means for supplying air to said air passage, said air tube assembly also including a longitudinal inlet passage disposed on one side of said air passage and a longitudinal outlet passage disposed on the opposite side of said air passage, means for supplying a cooling medium to said inlet passage, means for discharging the cooling medium from said outlet passage, the downstream ends of said inlet and outlet passages being connected, and a plurality of ports disposed in at least one side of said air tube assembly and communicating with said air passage, said ports being spaced along the length of said air passage and being disposed between said inlet and outlet passages, said ports including a first group facing upwardly at an angle to the horizontal, a second group facing downwardly at an angle to the horizontal and a third group facing generally horizontally.

4. An incinerator, comprising a combustion chamber, an elongated air tube disposed in the lower portion of the combustion chamber, means for supplying air to said tube, a first elongated generally U-shaped shroud secured to said air tube and defining with said air tube a first cooling medium passage extending substantially the full length of said air tube, a second generally U-shaped elongated shroud secured to the outer surface of the air tube and defining with said air tube a second cooling medium passage extending substantially the full length of said air tube, said first and second shrouds being generally U-shaped in cross section and each shroud including a pair of spaced legs and a connecting web, the legs of a first of said shrouds being spaced from the legs of the other of said shrouds to expose opposite portions of said air tube, means for supplying cooling medium to said first passage, means for discharging cooling medium from said second passage, means for establishing communication between the downstream ends of said passages, and a plurality of outlet ports spaced along the length of said air tube and disposed in said opposite portions of the air tube.

5. The incinerator of claim 4, wherein said air tube is inclined downwardly at an acute angle to the horizontal.

6. The incinerator of claim 4, wherein said outlet ports comprise three rows of holes in each of said opposite portions, the holes in a first of said rows facing upwardly and at an acute angle to the horizontal, the holes in a second of said rows facing downwardly at an angle to the horizontal and the holes in a third of said rows extending generally horizontally.

7. The incinerator of claim 4, wherein said means for supplying cooling medium comprises pumping means, and a first conduit connecting the discharge side of the pumping means to said first cooling medium passage, said means for discharging cooling medium comprises a second conduit connected to said second cooling medium passage, a surge tank connected to said second conduit, and a third conduit connecting said surge tank to the inlet side of said pump.

* * * * *